US010213818B2

(12) United States Patent
Totsky

(10) Patent No.: US 10,213,818 B2
(45) Date of Patent: Feb. 26, 2019

(54) METHOD FOR PREPARING HOT-ROLLED SEMIFINISHED STEEL ROLLED STOCK FOR COLD ROLLING

(71) Applicant: Ivan T. Totsky, Ekaterinburg (RU)

(72) Inventor: Ivan T. Totsky, Ekaterinburg (RU)

( * ) Notice: Subject to any disclaimer, the term of this patent is extended or adjusted under 35 U.S.C. 154(b) by 365 days.

(21) Appl. No.: 14/992,622

(22) Filed: Jan. 11, 2016

(65) Prior Publication Data

US 2016/0121380 A1 May 5, 2016

Related U.S. Application Data

(63) Continuation of application No. PCT/RU2014/000127, filed on Feb. 27, 2014.

(51) Int. Cl.
*B21B 1/22* (2006.01)
*B21B 45/06* (2006.01)

(52) U.S. Cl.
CPC ..... *B21B 1/22* (2013.01); *B21B 45/06* (2013.01); *B21B 2001/221* (2013.01); *B21B 2265/14* (2013.01); *B21B 2265/18* (2013.01)

(58) Field of Classification Search
CPC ..... B21B 1/22; B21B 2001/221; B21B 2001/228; B21B 1/28; B21B 2015/0071; B21B 45/0251; B21B 45/04; B21B 45/06; B21B 27/021; B21B 27/06
See application file for complete search history.

(56) References Cited

U.S. PATENT DOCUMENTS 2,306,792 A * 12/1942 Moore ..... B21B 1/28 428/600
3,269,007 A * 8/1966 O'Donnell ..... B21B 1/22 29/423
6,210,501 B1 * 4/2001 Okano ..... B21B 45/06 148/602
7,954,350 B2 * 6/2011 Takahama ..... B21B 45/0251 72/201
2005/0011243 A1 * 1/2005 Bunten ..... B21B 1/28 72/42
2006/0010952 A1 * 1/2006 Valence ..... B21B 1/28 72/226
2013/0025337 A1 * 1/2013 Nakao ..... C21D 8/0226 72/39
2014/0060428 A1 * 3/2014 Fujisawa ..... C21D 9/46 118/500

FOREIGN PATENT DOCUMENTS

JP 59-113901 A * 6/1984 ..... B21B 1/22
JP 61-049701 A * 3/1986 ..... B21B 1/22
JP 2011-79025 A * 4/2011 ..... B21B 1/22
RU 2060069 C1 5/1996
RU 2183516 C1 6/2002
RU 2492006 C1 9/2013

OTHER PUBLICATIONS

Machine Translation; JP 61-049701A, Mar. 1986.*
International Search Report from PCT/RU2014/000127 filed Feb. 27, 2014, dated Oct. 30, 2014.
Polukhin, P. I, et al, Rolling Production, 3rd Edition, 1982, pp. 485-487.

* cited by examiner

*Primary Examiner* — Edward T Tolan
(74) *Attorney, Agent, or Firm* — Patentbar International, P.C.

(57) ABSTRACT

The invention relates to the field of pressure treatment of metals and can be used in the production of a cold-rolled strip. The problem addressed by the invention is that of being able to exclude a pickling operation in the preparation of semifinished rolled stock for cold rolling. Complete de-scaling of the surface of the semifinished rolled stock without using picking is provided by carrying out preliminary cold rolling of the semifinished rolled stock in rolling-mill rolls according to prescribed values for compression and for the ratio of compression to deformation zone length. The rolling can be carried out in one of two consecutively mounted mills.

3 Claims, No Drawings

METHOD FOR PREPARING HOT-ROLLED SEMIFINISHED STEEL ROLLED STOCK FOR COLD ROLLING

RELATED APPLICATIONS

This Application is a Continuation Application of International Application PCT/RU2014/000127, filed on Feb. 27, 2014 which is incorporated herein by reference in their entirety.

FIELD OF THE INVENTION

The invention relates to the processing of metals by pressure and can be used in the preparation of hot-rolled semifinished steel stock for cold rolling in the production of cold-rolled steel strip.

BACKGROUND OF THE INVENTION

A method is known of preparing hot-rolled semifinished steel stock for cold rolling, including its preliminary cold rolling in the rolls of a temper mill having a preset hardness and surface roughness, to a preset reduction in the range of 2 to 4% depending on the planned tonnage of the strip, and its subsequent pickling (RU 2183516, pub. Jun. 20, 2002).

A method is known of preparing hot-rolled semifinished steel stock for cold rolling, including preliminary cold rolling in the rolls of a temper mill with regulated surface roughness parameters of the barrel of these rolls and density of the peaks of the contour line with relative reduction of 2-8%, increasing with increase in the reeling temperature of the hot-rolled strip into coils, and subsequent pickling (RU 2492006, pub. Jul. 24, 2012).

The common disadvantage of these known methods is that their preliminary cold rolling of the semifinished stock does not achieve sufficient mechanical breakdown of the scale and complete removal thereof from the surface of the semifinished rolled stock, necessitating subsequent pickling of the semifinished stock.

The closest analog to the present subject matter is a method for the preparation of hot-rolled semifinished steel stock for cold rolling that includes its preliminary cold rolling in the rolls of a temper mill with a reduction of 3-8% and subsequent pickling (see the P. Polukhin et al. book, Rolling, Moscow, "Metallurgy", 1982, pp. 485-487)—the prototype. The disadvantage of the prototype, as well as of the analogs, is the insufficient mechanical breakdown of the scale and incomplete removal thereof from the surface of the semifinished rolled stock during its preliminary cold rolling, which does not allow elimination of the subsequent pickling of the semifinished rolled stock.

SUMMARY OF THE INVENTION

The technical objective of the invention is the complete removal of the scale from the surface of the semifinished rolled stock during preliminary cold rolling of the semifinished stock, thereby eliminating the environmentally hazardous process of pickling the hot-rolled semifinished stock and its associated expenses.

The technical result is achieved by including in the method of preparing the hot-rolled semifinished steel stock for cold rolling a preliminary cold rolling step with defined reduction in the rolls of a rolling mill stand. The novelty of the method is that the preliminary cold rolling of the semifinished stock is carried out in the rolls of a rolling mill stand with a reduction of 12-35% at a 3.8±0.5%/mm ratio of reduction to the length of the deformation region. It is recommended that rolling at the above parameters be carried out in rolls of one of two sequential rolling mill stands. For the preliminary cold rolling of the semifinished rolled stock, it is recommended that a rolling lubricant be used between the surface of the semifinished rolled stock and the mill rolls. After the preliminary cold rolling of the semifinished rolled stock, when further processing calls for the reeling of the semifinished rolled stock into coils, it is straightened before reeling into coils; however, when further processing calls for feeding the semifinished rolled stock into a continuous rolling mill for its cold rolling with tension, the semifinished rolled stock is not straightened.

In the present method, complete removal of the scale from the surface of the semifinished rolled stock is achieved by the combined action of the following three factors:

1. Increasing reduction, and accordingly, increasing the drawing of the semifinished rolled stock. Increased drawing of the semifinished rolled stock makes it possible:
   - to increase the degree of mechanical breakdown of the brittle scale;
   - to increase the differences between the surface speed of the mill rolls and the linear speed of the semifinished rolled stock both in the backward and the forward creep zone of the deformation region, which provides the conditions for the mill rolls to strip off the sections of scale that have not sloughed off from the surface of the semifinished rolled stock during its drawing in the process of deformation.
2. By decreasing the diameter of the mill rolls in order to decrease the length of the deformation region, thereby ensuring 3.8±0.5%/mm ratio of reduction of the semifinished rolled stock to the length of the deformation region, which is approximately 3 times greater than in the prototype with 8% reduction of the semifinished rolled stock in rolls having a diameter, for example, of 500 mm. Increasing the ratio of reduction of the semifinished rolled stock to the length of the deformation region increases the difference between the surface speed of the mill rolls and the linear speed of the semifinished rolled stock per unit of length of the deformation region, that is, increases the intensity of the stripping by the mill rolls of sections of scale that have not sloughed off from the surface of the semifinished rolled stock during its drawing in the process of deformation. In addition, a short deformation region provides the conditions for the rolling of the semifinished rolled stock without the "rolled-in scale" defect.
3. By envelopment by rolling lubricant of the particles of scale sloughed and stripped by the mill rolls, which improves the conditions for the rolling of the semifinished rolled stock without the "rolled-in scale" defect.

DETAILED DESCRIPTION OF THE PREFERRED EMBODIMENTS

Hot-rolled semifinished steel stock undergoes preliminary cold rolling in the rolls of one of two sequential rolling mill stands with a reduction of 12-35% at a 3.8±0.5%/mm ratio of reduction to the length of the deformation region. During the replacement of the worn rolls in one mill stand, the rolling of the semifinished rolled stock is carried out in the other stand.

Reduction of the semifinished rolled stock by less than 12% is not recommended, since in order to obtain a 3.8±0.5%/mm ratio of reduction to the length of the deformation region, mill rolls having a diameter less than 80 mm would be required, for example, for the rolling of semifinished rolled stock 2.7 mm thick. It is technically difficult to ensure the use of rolls of this diameter in industrial conditions, especially for the rolling of wide semifinished rolled stock (having a width of 1500-2000 mm).

Reduction of the semifinished rolled stock by more than 35% is not recommended, since it results in an increase in the length of the deformation region and, accordingly, to the emergence of conditions for the formation of the "rolled-in scale" defect.

A ratio of reduction to the length of the deformation region below 3.3%/mm is not suitable, since it will not provide complete removal of the scale from the surface of the semifinished rolled stock, while higher than 4.3%/mm is not recommended, since the semifinished stock after rolling will have an extremely unsatisfactory flatness.

For cold rolling of semifinished stock with defined dimensions and reduction, mill rolls of the smallest possible diameters shall be used, at which sufficient durability is ensured to roll that stock.

Preliminary rolling of the semifinished rolled stock in rolls with the selected diameter shall be carried out with a reduction within the limits of 12-35%, at which the ratio thereof to the length of the deformation region is 3.8±0.5%/mm. This ensures complete removal of the scale from the surface of the semifinished rolled stock and the absence of the "rolled-in scale" defect.

A rolling lubricant, for example, spindle oil is recommended to be used between the surface of the semifinished rolled stock and the mill rolls in the preliminary cold rolling of the semifinished rolled stock. The lubricant envelops the particles of scale sloughed and stripped by the mill rolls, which improves the conditions for rolling of the semifinished rolled stock without the "rolled-in scale" defect.

In the present method, the significant increase in the reduction of the semifinished rolled stock and the decrease in the diameter of the mill rolls inevitably increase the rate of their wear and reduces the operating life of the rolls before reaching maximum wear. Despite this, the use in the proposed method of two sequential rolling mill stands makes it possible to carry out preliminary cold rolling of the semifinished rolled stock in one stand during the replacement of the worn rolls in the other. That is, the use of two rolling mill stands ensures the required production output in the preliminary cold rolling of the semifinished rolled stock.

In the present method, unstable friction conditions arise between the mill rolls and the surface of the semifinished rolled stock due to the discontinuity of the process of stripping by the rolls of sections of scale from the surface of the semifinished rolled stock, which results in unsatisfactory flatness of the stock after rolling. Therefore, when further processing of the semifinished rolled stock after the preliminary cold rolling calls for its reeling into coils, the stock is straightened before reeling into coils by any known method, for example, by straightening in a sheet-straightening machine. When further processing of the semifinished rolled stock after preliminary cold rolling calls for feeding the semifinished rolled stock into a continuous rolling mill for cold rolling with tension, the semifinished rolled stock is not straightened.

Example of a Specific Embodiment

Preliminary cold rolling of hot-rolled semifinished steel stock with a thickness h=2 mm and width 196 mm, grade 10 per GOST 1050 corresponding to grade DD11 under standard EN 10111, was done in a 480 four-high rolling mill stand. The working rolls of the rolling mill stand that are used for ordinary cold rolling of hot-rolled pickled semifinished steel stock had a diameter D=180 mm and a polished working surface (without ragging). The semifinished rolled stock was rolled without forward or backward tension with reduction ε=25% at a velocity of 1 meter per second. Spindle oil which is ordinarily used in the cold rolling of hot-rolled pickled semifinished steel stock was used as the rolling lubricant. The oil was fed at 1 drop per second into the middle of the width of the semifinished rolled stock immediately before it was rolled. The length of the deformation region L, determined according to the known equation $$L=\hat{}(0.5\cdot D)<2>-(0.5\cdot £>-0.5\cdot 0.01\cdot £\cdot \lambda)<2>,$$

was 6.7 mm, and the ratio of the reduction of the semifinished rolled stock to the length of the deformation region was 3.73%/mm. Results of the preliminary cold rolling of the hot-rolled semifinished steel stock at said parameters demonstrated complete removal of the scale from its surface and the absence of the "rolled-in scale" defect. After rolling, the semifinished rolled stock had unsatisfactory flatness; therefore, it was straightened in a sheet-straightening machine before reeling into coils.

More of the same semifinished rolled stock was then subjected to preliminary cold rolling with reduction of 12% by working rolls having a diameter of 90 mm, and with reduction of 35% by working rolls having a diameter of 230 mm. The length of the deformation region determined according to the equation indicated above was 3.28 and 8.97 mm, respectively. The ratio of reduction to the length of the deformation region was 3.65 and 3.90%/mm, respectively. Complete removal of the scale from the surface of the semifinished rolled stock in the absence of the "rolled-in scale" defect was obtained in both cases.

Thus, the results of the experiments confirmed the acceptability of the present technical solution for accomplishing the stated objective and its advantages over prior methods using the environmentally hazardous pickling process.

What is claimed is:

1. A method of removing scale from hot-rolled steel stock in preparation for cold rolling of the stock, the method comprising:

preliminary cold rolling the stock having a width up to 2000 mm in mill rolls having polished working surfaces using (i) a reduction of 12 to 35% and (ii) a 3.8±0.5%/mm ratio of the reduction to a length of a deformation region of the stock;

applying spindle oil between surfaces of the stock and the working surfaces of the mill rolls; and straightening the stock after the cold rolling of the stock.

2. The method according to claim 1, wherein a thickness of the stock is 2 mm, the mill rolls have diameters 90 mm, the reduction is 12%, and the ratio of the reduction to the length of the deformation region is 3.65%/mm.

3. The method according to claim 1, wherein a thickness of the stock is 2 mm, the mill rolls have diameters 230 mm, the reduction is 35%, and the ratio of the reduction to the length of the deformation region is 3.90%/mm.

* * * * *